165-78
10/22/85 OR 4,548,260

United States Patent [19]
Stachura

[11] Patent Number: 4,548,260
[45] Date of Patent: Oct. 22, 1985

[54] HEAT EXCHANGER

[75] Inventor: Victor J. Stachura, E. Amherst, N.Y.

[73] Assignee: American Precision Industries, Inc., Buffalo, N.Y.

[21] Appl. No.: 474,521

[22] Filed: Mar. 11, 1983

[51] Int. Cl.[4] ..... F28D 7/00
[52] U.S. Cl. ..... 165/78; 165/160
[58] Field of Search ..... 165/76, 78, 160, 162

[56] References Cited

U.S. PATENT DOCUMENTS 2,552,416 5/1951 Farkas ..... 165/78 X
4,415,024 11/1983 Baker ..... 165/78 X

FOREIGN PATENT DOCUMENTS 2027864 2/1980 United Kingdom ..... 165/111

*Primary Examiner*—William R. Cline
*Assistant Examiner*—Peggy A. Neils
*Attorney, Agent, or Firm*—Christel, Bean & Linihan

[57] ABSTRACT

A heat exchanger having a cylindrical shell divided into upper and lower chambers. A tube bundle may be disposed within the lower chamber, the tube bundle having spaced apart inlet and outlet sides which can be disposed either to one side or the other thereby permitting greater placement of the inlet and outlet ports on the shell. To this end the structure which divides the shell into upper and lower chambers includes a generally horizontal longitudinally extending plate assembly provided with openings to either side of a vertically extending barrier wall used for controlling the flow of air. Longitudinally extending guide bars are secured to the lower surface of the horizontal plate. The tube bundle includes upper and lower longitudinally extending shrouds, each of which is provided with a mounting bracket which extends away from the shroud along a longitudinally extending vertical plane which bisects the center of gravity of the tube bundle. Supporting means are provided for mounting the tube bundle within the shell, the supporting means including a lower roller and seal assembly and an upper stabilizer assembly, each of which may be secured to an associated mounting bracket. The lower roller and seal assembly includes a plurality of longitudinally spaced apart rollers each pair of rollers including individual rollers which are spaced apart to opposite sides of a longitudinally extending centrally located seal. The upper stabilizer assembly also includes a longitudinally extending seal and stabilizers disposed to either side of the seal.

6 Claims, 9 Drawing Figures

Fig. 3.
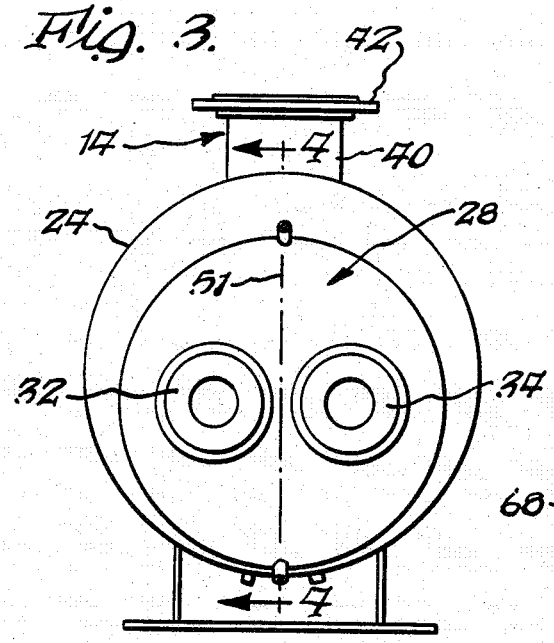
Fig. 5.
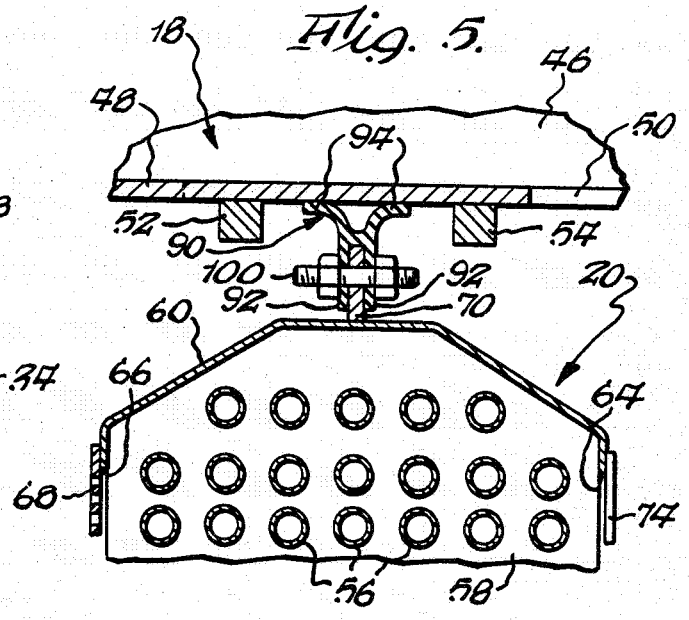
Fig. 6.
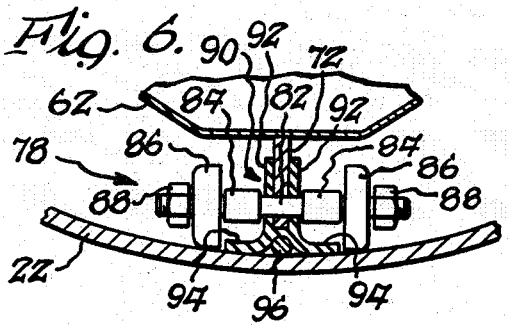
Fig. 7.
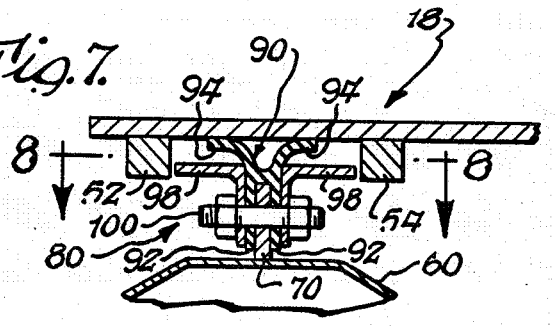
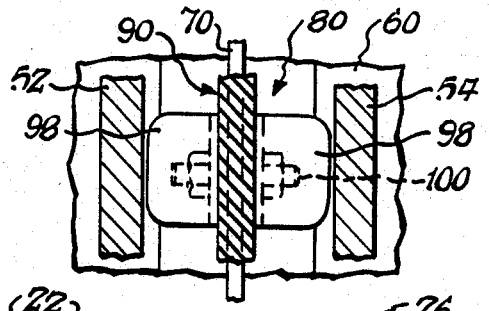
Fig. 8.
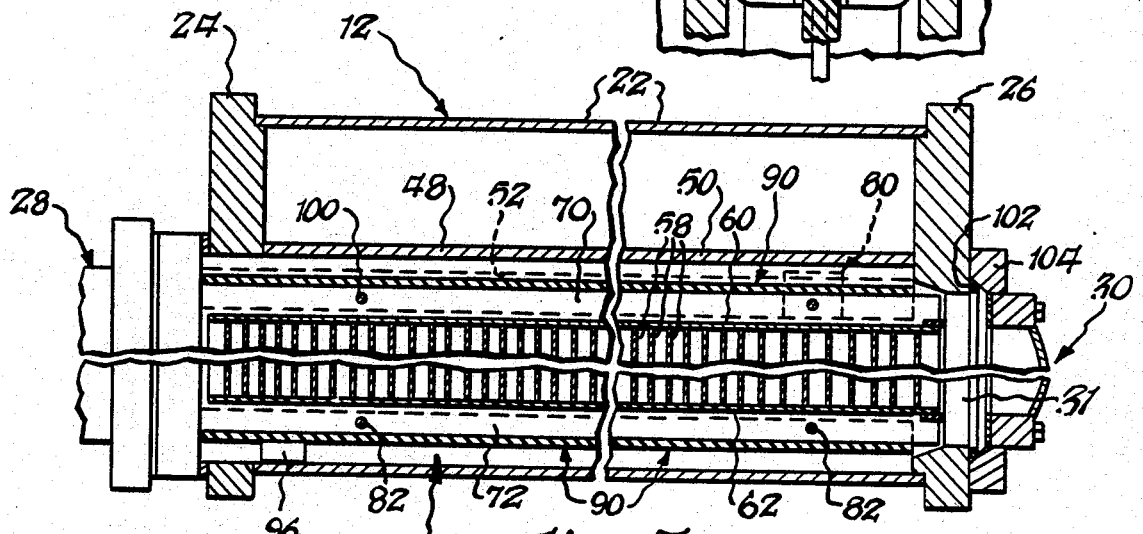
Fig. 4.

HEAT EXCHANGER

FIELD OF THE INVENTION

The present invention relates generally to heat exchangers and more particularly to heat exchangers of the tube and plate type wherein a gas may be cooled by passing it through a tube and plate bundle.

BACKGROUND OF THE INVENTION

Heat exchangers of the type described in U.S. Pat. No. 3,532,160 have been extensively and successfully used and offer many advantages, including high efficiency and the ability to position inlet and outlet ports at any location lengthwise of the shell within a range equaling approximately half the shell length. An improvement for the above design is disclosed in U.S. Pat. No. 4,382,467 (Ser. No. 223,114) which design has improved heat transfer and assembly characteristics.

Heat exchangers of the type shown in the foregoing patents frequently find utility as compressor intercoolers or as aftercoolers, and it is a design criteria that there should be minimal pressure drop between the inlet and outlet sides, and also that the inlet and outlet ports may be positioned in various locations to conform with the compressors. The heat exchangers can be mounted either vertically or horizontally. For purposes of convenience,in the following description and claims the heat exchangers will be described in a horizontal position, however applicant does not intend for his invention to be so positioned.

OBJECTS AND SUMMARY OF THE INVENTION

It is an object of the present invention to further improve the assembly and heat transfer characteristics of the above-mentioned patents.

More particularly, it is an object of the present invention to provide a heat exchanger of the type referred to above which can be more readily assembled and which provides for a greater variety of placement of the inlet and outlet ports.

Thus, it is an object of the present invention to provide a heat exchanger of the type having a cylindrical shell divided into upper and lower chambers, a tube bundle being disposable within the lower chamber, which tube bundle has spaced apart inlet and outlet sides, and means whereby the tube bundle can be assembled within the lower chamber with the inlet side either disposed to one side of the lower chamber or to the other side thereby permitting greater placement of the inlet and outlet ports, the assembly means also facilitating the assembly of the tube bundle within the cylindrical shell.

The above objects and other objects and advantages of this invention are accomplished by providing a closed longitudinally extending shell having dividing means disposed within the shell, the dividing means including a generally vertical barrier wall and a generally horizontal longitudinally extending plate assembly spaced away from the top wall and being provided with openings to either side of the barrier wall. The shell is provided with inlet and outlet ports in its top wall to either side of the barrier wall. A longitudinally extending tube bundle is disposed between the plate assembly and the bottom wall of the shell, the tube bundle including, in addition to longitudinally extending tubes and transversely extending plates, upper and lower longitudinally extending shrouds each having first and second longitudinally extending peripheral edges, there being an inlet opening to the tube bundle between the first peripheral edges of the upper and lower shrouds, and an outlet opening between the second peripheral edges. Each shroud also is provided with a mounting bracket which extends away from the shroud, the mounting bracket being disposed along the center line of the shroud. Supporting means are provided for mounting the tube bundle within the shell, the supporting means including a lower roller and seal assembly and an upper stabilizer assembly. The lower roller and seal assembly includes a plurality of longitudinally spaced apart pairs of rollers, each pair of rollers including individual rollers which are spaced apart to opposite sides of a longitudinally extending centrally located seal. The upper stabilizer assembly also includes a longitudinally extending seal and stabilizers disposed to either side of the seal.

The above and additional details are more fully set forth in the following detailed description and accompanying drawings.

BRIEF DESCRIPTION OF THE DRAWINGS

FIG. 3 is an end view of the heat exchanger shown in FIG. 2, showing coolant connections of the exchanger.

FIG. 4 is an enlarged sectional view taken along the line 4—4 in FIG. 3, portions being broken away.

FIGS. 5, 6, and 7 are enlarged sectional views taken along the lines 5—5, 6—6, and 7—7 on FIG. 2.

FIG. 8 is a sectional view taken along the line 8—8 in FIG. 7.

DETAILED DESCRIPTION OF A PREFERRED EMBODIMENT

Figure 1:
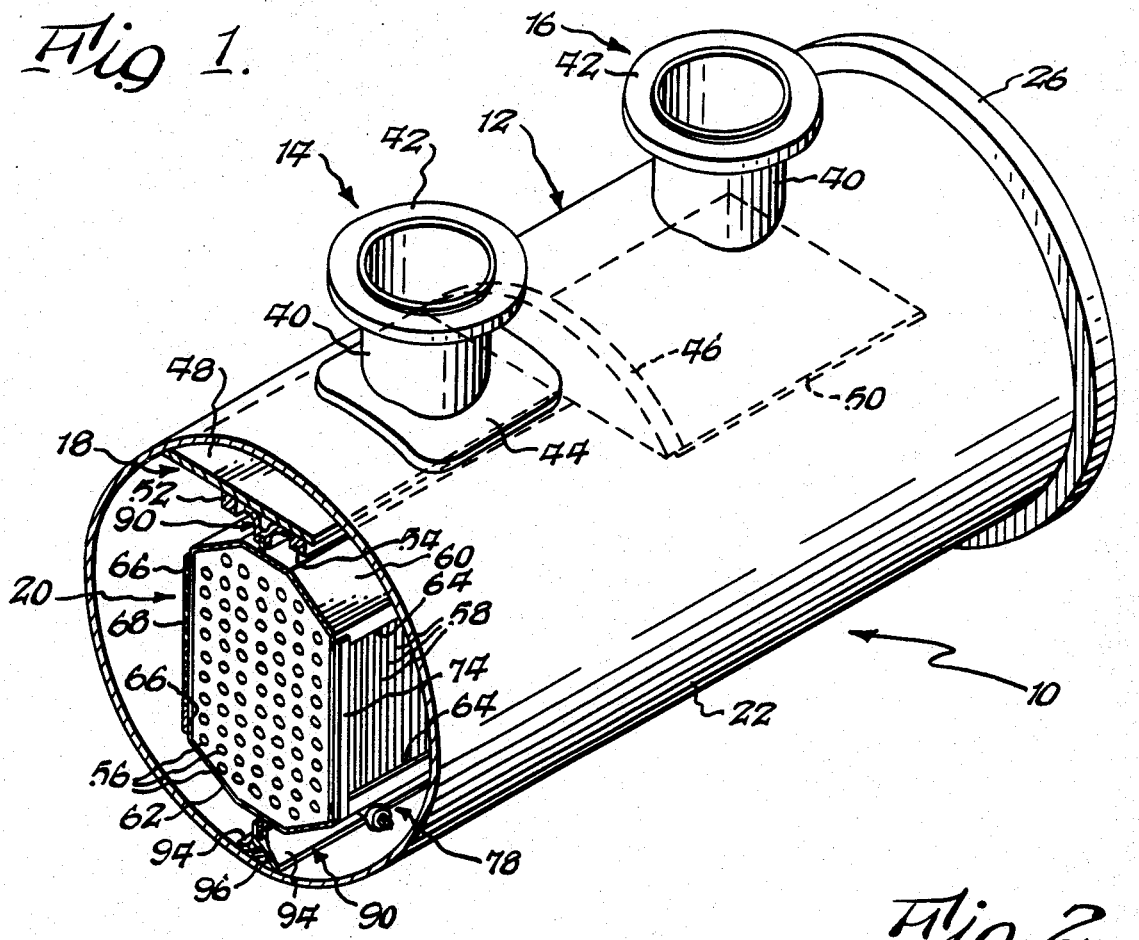
FIG. 1 is an isometric view of a heat exchanger in accordance with the principles of this invention, one end being broken away.

Referring first to FIG. 1 a heat exchanger is indicated generally at 10, the heat exchanger including a generally cylindrical closed longitudinally extending shell assembly, indicated generally at 12 first fluid, inlet and outlet ports to and from the interior of the shell assembly, indicated generally at 14 and 16, respectively, baffling or dividing means which includes a longitudinally extending plate assembly indicated generally at 18, and a longitudinally extending tube bundle indicated generally at 20. When the heat exchanger of this invention is used with an air compressor, the first fluid will be air. The cooling or second fluid, which passes through the tube bundle, will customarily be water.

Figure 2:
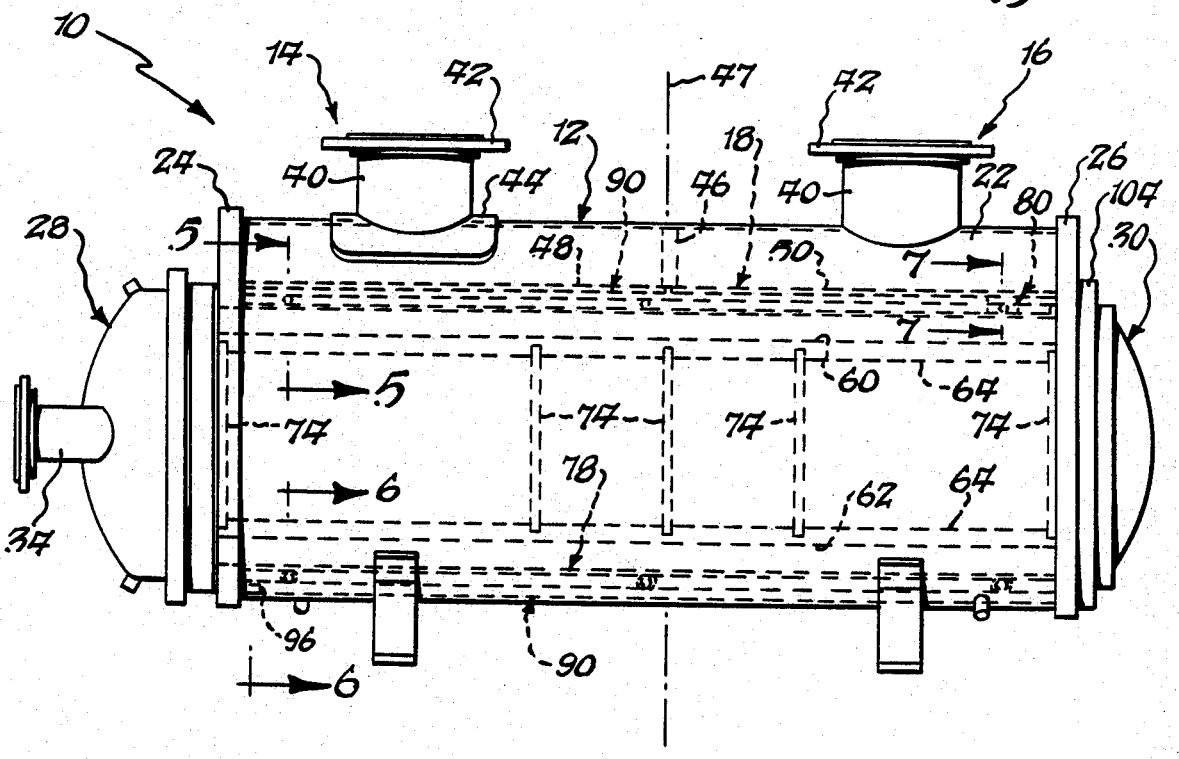
FIG. 2 is a side view of the heat exchanger shown in FIG. 1.

The shell assembly 12 includes a longitudinally extending cylindrical portion 22 which is provided with left and right flanges 24, 26, respectively, (FIG. 2). The assembled heat exchanger also includes an inlet/outlet bonnet assembly 28 which is interconnected to the left flange 24 by bolts or the like (not shown) and serves to close off the left hand end of the shell portion 22, and a reversing bonnet assembly 30 which passes through the right flange 26 and serves to close off the right hand end of the cylindrical portion 22. The inlet/outlet bonnet 28 is provided with suitable cooling or second inlet and outlet ports 32, 34, respectively, (FIG. 3), and cooling fluid, such as water, may be introduced into the cooling fluid inlet port 32 and caused to flow through the tubes within the tube bundle and exit through the cooling fluid outlet port 34. The manner in which the inlet/outlet bonnet assembly 28 is secured to the tube bundle 20 is not material to the present invention and will not be discussed further herein as various designs are well known to those skilled in the art. Similarly, the manner in which the reversing bonnet 30 is secured will also not be discussed herein.

Each of the first fluid or air inlet and outlet ports 14, 16 includes, in addition to a suitable aperture in the top of the shell assembly, a vertically extending cylindrical section 40 and a top flange 42. In addition a reinforcing saddle 44 may be provided. The cylindrical section 40 and the reinforcing saddle 44 of each of the air ports are all suitably welded to the top wall of the cylindrical portion 22.

Disposed within the shell are baffle or dividing means which include the longitudinally extending plate assembly 18 and, in the embodiment of FIGS. 1–8, a transversely extending barrier wall 46. The barrier wall 46 may be disposed in the center or transverse vertical plane 47 (FIG. 2), but can also be disposed to one side of the center plane 47. The longitudinally extending plate assembly 18 is preferably formed of left and right hand plates 48, 50 which extend away from the barrier wall 46 to the flanges 24, 26. As can best be seen from FIG. 1 each of the plates 48, 50 may extend from one side of the cylindrical or tubular section 22 a short distance past a longitudinally extending vertical plane 51 (FIG. 3) leaving an opening between the end of the plate 48, 50 and the opposite side of the tubular portion 22. When viewed from the side of the inlet/outlet bonnet 28, the opening defined by the plate 48 and the shell 22 is to the right hand side of the longitudinally extending vertical center plane 51, while the opening defined by the plate 50 is to the left hand side of the plane 51. While the plate assembly has been described as being formed of two plates 48 and 50, it should be appreciated that if it were desired this could be formed from a single plate. The longitudinally extending plate assembly 18 also includes a pair of depending longitudinally extending guide bars 52, 54 to either side of the longitudinal plane 51, the purpose of which will be described below.

As previously noted, air inlet and outlet ports 14 and 16 are carried by the shell. Thus, the air inlet and outlet ports may be disposed to either side of the barrier wall 46. In the embodiment shown in FIGS. 1–8 each of the air ports 14, 16 is disposed along the center line of the shell top wall, defined by the intersection of the top wall with the longitudinally extending vertical plane 51 (FIG. 3). Thus, the air inlet port 14 can be disposed anywhere along the shell top wall center line to one side of the barrier wall 46 and in a like manner the air outlet port 16 can be disposed anywhere along the center line to the other side of the barrier wall 46.

The longitudinally extending tube bundle 20 inlcudes a plurality of longitudinally extending tubes 56 which are structurally interconnected to each other by a plurality of transversely extending plates or fins 58. Disposed above and below the tube and plate assembly 56, 58 are opposed upper and lower longitudinally extending shrouds 60, 62, respectively. The shrouds each have a central horizontally disposed portion and spaced apart side portions which extend away from the central portion at an angle towards the opposite shroud. The shrouds are further provided with short vertically extending portions which define longitudinally extending first and second edges 64, 66. An air inlet to the tube and plate assembly is defined between the first peripheral edges 64 of the upper and lower shrouds, and similarly, an air outlet from the tube and plate assembly is defined between the second peripheral edges 66 of the upper and lower shrouds. A perforated plate 68 is secured to the second edges 66 of the upper and lower shrouds 60, 62 to insure a proper flow of air through the tube and plate assembly.

Upper and lower longitudinally extending mounting brackets 70, 72, respectively, are provided, each of the mounting brackets being customarily secured to a longitudinally extending mid-portion or center line of an associated shroud and extending away therefrom at generally right angles. It should be obvious from what follows that in practice it is desirable that the mounting brackets lie in a vertical plane which passes through the center of gravity of the tube bundle 20. Thus, in practice, the brackets may be offset from the longitudinal midportion of the associated shroud. The mounting brackets 70 and 72 may be secured to the shrouds by welding or the like. In this connection it should also be noted that the tube bundle 20 is provided with tie bars 74 which extend across the inlet side to the tube bundle.

Supporting means are provided for supporting the longitudinally extending tube bundle between the plate assembly 18 and the bottom wall of the cylindrical portion 22 of the shell 12. The supporting means includes a lower roller and seal assembly best illustrated in FIG. 6 and indicated generally at 78, and an upper stabilizer assembly best illustrated in FIG. 7 and indicated generally at 80. Both the lower roller and seal assembly 78 and the upper stabilizer assembly 80 are secured to the mounting brackets 70, 72 and serve to dispose the mounting brackets longitudinally extending vertical plane indicated at 51 in FIG. 3.

Each of the lower roller and seal assemblies include a shaft 82 threaded at each end and which is adapted to be passed through a suitable aperture in the mounting plate 72. Disposed to either side of the mounting plate are spacers 84. Disposed outwardly of the spacers 84 are rollers 86 which are suitably journalled about the shaft 82. Finally, nuts 88 are disposed outwardly of the rollers and are adapted to maintain the various parts in their assembled position. Three roller assemblies are preferably utilized, although a differing number may be employed. In addition, one longitudinally extending seal, indicated generally at 90, is also employed as part of the lower roller and seal assembly. The lower seal includes a pair of spaced apart parallel legs 92 which may be suitably apertured for the reception of shaft 82, and a bifurcated portion 94. The seal is assembled with the legs 92 straddling the mounting bracket 72 in the manner illustrated in FIG. 6. In order to insure that the bifurcated portion 94 of the seal is properly spread, a spreader member 96 is provided, the spreader member being secured to one end of the shell 22. The manner in which the spreader member 96 is utilized will be described below. It should be observed from FIG. 6 that the spacers 84 insure that the rollers are sufficiently far away from each other that when the bifurcated portion 94 is fully spread that the rollers will not contact the seal but in fact will contact the bottom wall of the shell 22.

The upper stabilizer assembly includes a pair of stabilizers 98 in the form of angles, the angles being secured to a seal 90 and upper mounting bracket 70 by a suitable fastener indicated at 100. The upper seal 90 is identical to the lower seal 90 utilized in the lower roller and seal assembly and extends the full length of the mounting bracket 70 whereas the stabilizers 98 are only disposed at one end of the mounting bracket 70.

The tube bundle is assembled after the shell 22 has been provided with the air ports 14 and 16 and the dividing means including the plate assembly 18 and the barrier wall 46 are installed. At this point it is then necessary to insert the tube bundle 20. During assembly the shell assembly is preferably disposed in the horizontal position shown in FIG. 2. The tube bundle 20 is inserted from left to right as viewed in FIG. 2 and thus the leading edge of the lower seal 90 is initially contacted by the spreader 96 to cause the seal to spread. The rollers 86 roll along the bottom of the shell as the tube bundle is being inserted and the brackets 98 engage the bars 52, 54 to insure that the rollers run along opposite sides of the longitudinally extending vertical center plane 51. After the tube bundle 20 is inserted into the shell 22, the inlet/outlet bonnet and the reversing bonnet are assembled onto the tube bundle.

The bonnet 30 has a portion 31 of only slightly smaller diameter than a corresponding aperture within flange 26. The bonnet 30 can move axially relative to the flange 26 after assembly due to thermal expansion and contraction, and the shell assembly is sealed by an O-ring 102 and O-ring retainer 104 secure to flange 26 by bolts or the like.

As previously noted, the air inlet and outlet ports can be positioned anywhere along the center line to one side of the barrier wall or the other. In the embodiment illustrated in FIG. 1 the inlet port is disposed to the left hand side of the barrier wall and the outlet port is disposed to the right hand side. In this configuration the compressed air will flow into the inlet through the opening to the right of the left plate 48, through the inlet defined between the first edges 64 and thus exit from the tube bundle through the outlet defined between the second edges 66 and the perforated plate 68 and then will flow through the outlet port 16. If it were desired to reverse the position of the inlet and outlet ports it would also be necessary to reverse the position of the tube bundle and thus, it would be necessary to dispose the perforated plate on the right hand side (as viewed in FIG. 5) rather than on the left hand side. To this end the supporting means are so designed that the lower roller and seal assembly and the upper stabilizer assembly can be secured to either one of the mounting brackets 70, 72. Thus, if it were desired to change the location of the inlet and outlet ports the lower roller and seal assembly could be secured to mounting bracket 70 and the upper seal assembly could be secured to the other mounting bracket 72 and the entire tube bundle could be rotated 180° about its longitudinal axis to position the perforated plate in the right side portion. Thus, the foregoing design greatly facilitates the placement of the inlet and outlet ports to virtually any desired location.

In addition, a seal having a bifurcated portion is also known to provide a better barrier between the hot gases on one side of the tube bundle and the cooled gases on the other side and the present design permits the use of such a seal. Such seals are well known in the prior art as can be seen from U.S. Pat. No. 2,550,725.

Figure 9:
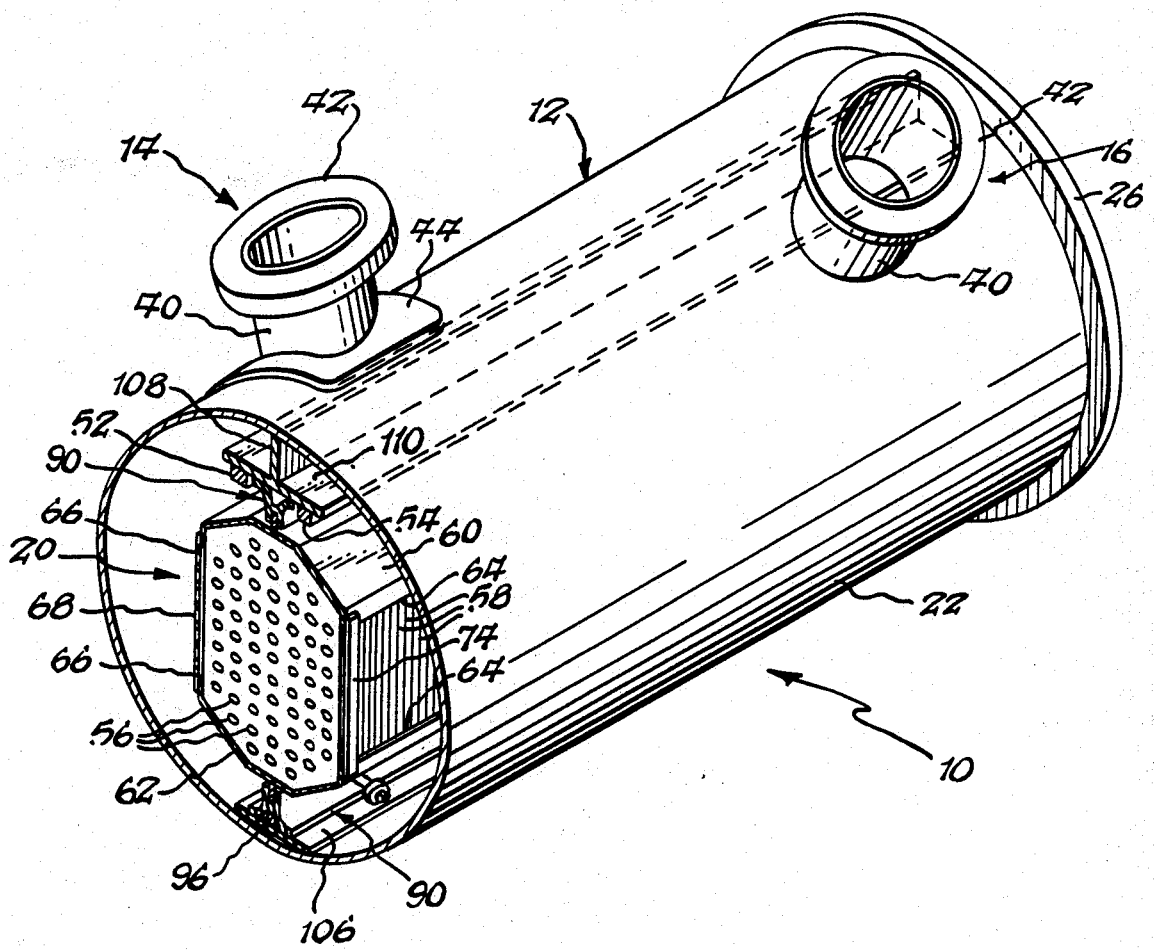
FIG. 9 is a view similar to FIG. 1 illustrating a modified version of the heat exchanger shown in the preceding figures.

Referring now to the embodiment illustrated in FIG. 9 like parts are indicated by like reference numerals. In this embodiment differing dividing means are illustrated, and in addition a reinforcing plate 106 is provided in the bottom wall of the cylindrical portion 22. Thus, it has been found that in very large units it is desirable that the bottom of the pipe 22 be reinforced.

In the design illustrated in FIG. 1 it is contemplated that the inlet and outlet ports will be disposed along the shell top wall center line, although in fact they could be to one side or the other of such center line provided that the inlet and outlet ports are on opposite sides of a barrier wall. In some designs it may be desirable to use a longitudinal central barrier wall or baffle rather than a transverse barrier wall 46. To this end, as shown in FIG. 9, the dividing means is provided with a longitudinally extending barrier wall 108 which extends between the top wall of the cylindical portion 22 and a longitudinally extending plate 110. As can be seen from this figure there is an opening to either side of the plate 110. Also, bars 52 and 54 are secured to the plate 110, the bars serving the same purpose as in the prior embodiment. It should be observed that with this design the air inlet and outlet ports must be disposed to opposite sides of the barrier wall 108, but could both be on the same side of a transverse center plane 47.

While preferred embodiments in which the principles of the present invention have been incorporated are shown and described above, it is to be understood that the particular invention is not to be limited to the particular details, shown and described above, but that, in fact, widely differing means may be employed in the practice of the broader aspects of this invention.

What is claimed is:

1. A heat exchanger comprising:

a closed longitudinally extending shell having top and bottom walls and spaced apart fluid inlet and outlet ports in said top wall;

dividing means disposed within said shell, said dividing means including a longitudinally extending plate assembly spaced away from the top wall;

a longitudinally extending tube bundle disposed between the plate assembly and the bottom wall of the shell, said tube bundle including a plurality of longitudinally extending tubes and opposed upper and lower longitudinally extending shrouds, each having first and second longitudinally extending peripheral edges and a center line between the edges, there being an inlet to the tube bundle between the first peripheral edges of the upper and lower shrouds and an outlet to the tube bundle between the second peripheral edges of the upper and lower shrouds;

upper and lower longitudinally extending mounting brackets secured to the upper and lower shrouds adjacent their center lines, respectively, the mounting brackets extending away from said shrouds at generally right angles thereto;

supporting means for supporting the tube bundle within the shell for assembly movement relative thereto, said supporting means including an upper stabilizer assembly secured to said upper mounting bracket and engageable with said longitudinally extending plate assembly, and a lower roller and seal assembly secured to said lower mounting bracket and engageable with said bottom wall of the shell, said assembly including a plurality of longitudinally spaced apart pairs of rollers carried by said mounting bracket, the individual rollers of each of said pair of rollers being disposed on opposite sides of said mounting bracket, and extending outwardly therefrom, and a longitudinally extending seal carried by said mounting bracket and disposed between the rollers of each pair and extending outwardly therefrom.

2. The heat exchanger as set forth in claim 1 wherein said lower roller and seal assembly further includes spacers disposed between each of said rollers and the longitudinally extending seal.

3. The heat exchanger as set forth in claim 1 wherein the longitudinally extending seal has a downwardly and outwardly extending bifurcated portion, said heat exchanger further being characterized by the provision of a spreader member mounted at one end of the bottom wall of the shell adjacent its center line, the spreader member being capable of spreading the bifurcated portion of the seal during assembly.

4. A heat exchanger comprising:

a closed longitudinally extending generally cylindrical shell having top and bottom walls and spaced apart fluid inlet and outlet ports in said top wall;

dividing means disposed within said shell, said dividing means including a longitudinally extending plate assembly spaced away from the top wall, said plate assembly including a generally planar normally horizontally disposed member, guide means extending downwardly from said horizontally disposed member, and a barrier wall extending between the generally planar normally horizontally disposed member and the top wall, said barrier wall being disposed between said spaced apart fluid inlet and outlet ports, the generally planar normally horizontally disposed member being provided with an opening on one side of the barrier wall and with a corresponding opening on the other side of the barrier wall;

a longitudinally extending tube bundle disposed between the plate assembly and the bottom wall of the shell, said tube bundle including a plurality of longitudinally extending tubes and opposed upper and lower longitudinally extending shrouds, each have first and second longitudinally extending peripheral edges and a center line between the edges, there being an inlet to the tube bundle between the first peripheral edges of the upper and lower shroud and an outlet to the tube bundle between the second peripheral edges of the upper and lower shrouds;

upper and lower longitudinally extending mounting brackets secured to the upper and lower shrouds adjacent to their center lines, respectively, the mounting brackets extending away therefrom at generally right angles thereto; and supporting means for supporting said tube bundle within said shell for assembly movement relative thereto, said supporting means including a lower roller and seal assembly secured to said lower mounting bracket and engageable with said bottom wall of said shell and an upper stabilizer assembly secured to said upper mounting bracket and engageable with said guide means to stabilize said tube bundle.

5. The heat exchanger as set forth in cliam 4 wherein said barrier wall extends transversely.

6. The heat exchanger a set forth in claim 4 wherein said barrier wall extends longitudinally.

* * * * *